United States Patent [19]

Phelps

[11] 4,125,428

[45] Nov. 14, 1978

[54] VERTICAL TWIN WIRE PAPER MACHINE

[75] Inventor: Richard W. Phelps, Fulton, N.Y.

[73] Assignee: The Black Clawson Company, Middletown, Ohio

[21] Appl. No.: 810,054

[22] Filed: Jun. 27, 1977

[51] Int. Cl.[2] ..... D21F 1/00; D21F 1/54

[52] U.S. Cl. ..... 162/301; 162/306; 162/352; 162/364

[58] Field of Search ..... 162/301, 306, 352, 364, 162/203, 217

[56] References Cited

U.S. PATENT DOCUMENTS

| | | | |
|---|---|---|---|
| 3,573,161 | 3/1971 | Notbohm | 162/301 |
| 3,578,556 | 5/1971 | Notbohm et al. | 162/203 |
| 3,772,145 | 11/1973 | Notbohm | 162/301 X |
| 3,810,818 | 5/1974 | Arledter | 162/301 |
| 3,839,143 | 10/1974 | Suckow | 162/301 X |
| 3,941,651 | 3/1976 | Koski | 162/301 |

*Primary Examiner*—Richard V. Fisher
*Attorney, Agent, or Firm*—Biebel, French & Nauman

[57] ABSTRACT

In a vertical twin-wire paper machine, the initial forming zone is a wedge-shaped zone defined by a small number of deflectors arranged to bring the two wires into pressure engagement with the sheet therebetween and to remove the initial free or rapidly draining water from between the wires as quickly as possible, consistent with good sheet formation with the economical retention of formed components. The two wires and the sheet therebetween travel through a pressure zone which includes a convexly curved intermittent surface and guide rolls arranged to guide the wires from the wedge zone into wrapping engagement with the intermittent surface under tension causing pressure on the sheet and continued extrusion of liquid through one or both wires. More than one such intermittent surface may be used, and the final travel of the wires and sheet is to a suction couch roll where the top wire is peeled away at the suction box, leaving the sheet on the upper surface of the bottom wire for pickup and transfer by conventional sheet handling techniques.

11 Claims, 5 Drawing Figures

VERTICAL TWIN WIRE PAPER MACHINE

BACKGROUND OF THE INVENTION

This invention relates to twin wire paper making machines wherein a pair of reaches of the forming wires are guided in generally vertically traveling relation to define the forming zone wherein the paper is formed by extrusion of the liquid through the wires as the vertically traveling reaches converge into essentially parallel relation with the sheet therebetween, and wherein these wires thereafter separate to leave the sheet exposed on one wire from which it is then transferred to a felt for travel to the next processing station. Among the United States patents issued to the same assignee to which special reference should be made as illustrating relevant art are Baxter Re U.S. Pat. Nos. 25,333, Notbohm 3,573,161, Notbohm et al 3,578,556 and 3,597,315, and McCarrick et al 3,578,561.

The present invention has special relation to Notbohm U.S. Pat. No. 3,573,161, wherein the wires are guided along and beyond the forming zone in a path generally resembling the letter J, and are then caused to separate in such manner that the sheet is exposed on the upper surface of one of the wires so that it can be handled by conventional pick-up means for transfer to the press section.

SUMMARY OF THE INVENTION

The principal object of this invention is to provide a twin wire paper machine which offers all the advantages of the construction disclosed in U.S. Pat. No. 3,573,161, and which in addition offers the special advantage of a wide range of control over the sheet forming conditions, in order to increase the versatility of a given machine in terms of the range and quality of papers which can be produced thereon, and also the further advantage of improved drainage as well as of improved control over the newly formed sheet until it is transferred to the next processing station.

An essential characteristic of the invention is that the forming zone of the paper machine be designed to effect formation of the sheet over as short as possible a run of the wires while also providing a maximum of control of the forming conditions as may be desired for sheet qualities or properties. The basic objective of this forming zone is the removal of free liquid by similar treatment and support of both wires along the opposite sides of the wedge shaped forming zone by means of a suitable arrangement of deflectors, properly distributed between the two wires in vertically staggered relation. Additionally the invention provides for merging the initial wedge zone into a pressure zone by bringing the two wires into pressure engagement with the sheet therebetween as quickly as is consistent with the formation of the sheet and stock retention. The pressure zone may include, or may merge into, a vacuum zone for effecting increased drainage.

The most important of these several zones is the wedge zone wherein initial formation of the sheet takes place under carefully controlled drainage conditions, in accordance with the principles of the invention which involve calculation of the desired drainage rate and the solids consistency desired at successive stages of formation in the wedge zone, as described hereinafter in conjunction with the drawings.

The general principle is that depending upon the initial stock consistency as delivered by the headbox and the desired consistency at the small end of the wedge zone, the thickness of the stock at the intermediate level of each of the deflectors which define the wedge zone can be calculated in accordance with the desired drainage rate. This thickness value is used to establish the lateral position of each deflector with respect to the plane connecting the opposed pair of deflectors supporting the other wire, with the result that both wires are not caused to change direction in passing over the same deflector, and thus do not attain effective pressure engagement with the newly formed sheet which lies between them until they have passed the last deflector.

The invention also provides for maintaining the wires and the sheet therebetween in pressure engagement after leaving the wedge zone by causing them to travel from the last deflector at the downstream end of the wedge zone to and over a convexly curved intermittent surface against which they are held by tension. This intermittent surface may be, for example, a convexly curved open shoe type structure which makes bowing engagement with one of the wires between a turning roll and the most downstream deflector to maintain the other wire under tension and in pressure engagement with the sheet causing continued pressure and time for extrusion of liquid through both wires as they travel over the shoe structure, or through the wire engaging the intermittent surface if suction is applied from the other side of the surface. The intermittent surface to which the wires travel from the last deflector may also be an open faced roll, e.g. a suction roll, followed by an open structure under a generally horizontal run of the wire and sheet.

Further control over the drainage from the new sheet is effected by guiding the wires and sheet under tension over an additional intermittent surface as the wires and sheet travel downstream to a suction couch roll, thereby maintaining the desired pressure engagement between the wires and the sheet for further drainage as they travel to the couch roll.

At the suction couch roll, the wires are guided in such manner that the upper wire is separated from the sheet and the lower wire after contact with the suction couch roll, with the lower wire and sheet wrapping the suction box of the couch roll for a sufficient distance beyond the line of separation of the upper wire to assure that the sheet will be held on the lower wire as the upper wire is peeled away from the sheet. Thereafter, the sheet is readily transferred from the lower wire by a conventional pick-up roll and felt.

The invention is applicable both to twin wire paper machines wherein the wires travel downwardly along the forming zone, as in U.S. Pat. No. 3,578,556, and also to twin wire paper machines wherein the wire travels upwardly along the forming zone, as in U.S. Pat. No. 3,597,315. The same advantages are provided by the invention in either such configuration of paper machine.

DESCRIPTION OF THE PREFERRED EMBODIMENTS

Figure 1:
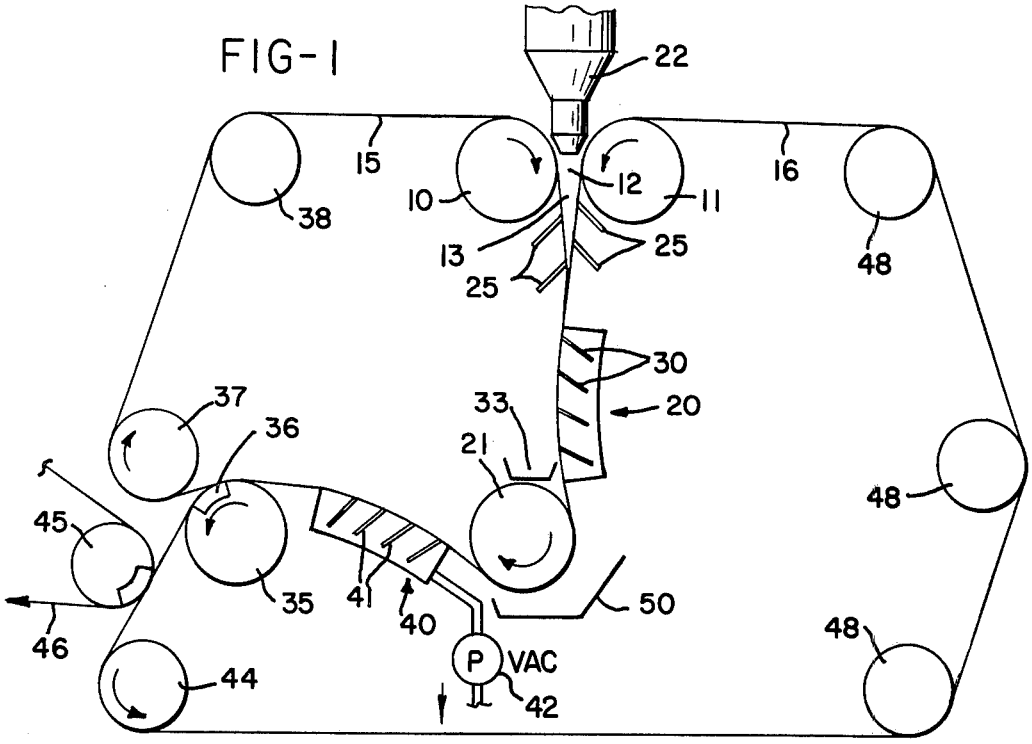
FIG. 1 is a side elevation illustrating diagrammatically a form of twin wire paper machine and sheet pick-up arrangement in accordance with the invention wherein the wires travel downwardly along the forming zone.

FIG. 1 shows the basic elements of the paper machine forming section, including the breast rolls 10 and 11 supported in horizontally spaced relation to define the mouth 12 of the wedge zone 13 wherein initial forming of the sheet takes place. The sides of the wedge zone 13 are defined by downwardly traveling reaches of the two forming wires 15 and 16 which converge to near parallelism with the sheet therebetween and together travel across the open shoe type structure 20 and then wrap the turning roll 21 which is generally vertically below the breast roll 10. A headbox 22 is positioned above the breast rolls 10-11 to deliver stock through the mouth 12 into the wedge zone 13 as a sheet-like jet in accordance with U.S. Pat. No. 3,578,556.

The wedge zone 13 is defined by the downwardly traveling wire reaches in combination with a plurality of deflectors 25 which guide and support the wire reaches as they converge from the mouth 12 into increasingly substantially parallel relation as the free liquid is extruded therethrough and thereby cause the sheet to be formed therebetween. For preferred results and easy running, there should be as few deflectors 25 as possible, and they should be constructed and arranged, e.g. in accordance with U.S. Pat. No. 3,578,561, in adjustably mounted and vertically staggered relation.

It must be understood that the deflectors 25 are shown diagrammatically and out of proportion in FIG. 1. In actual use, the mouth 12 will be proportionately wider than the slice opening of headbox 22, and each successive deflector will more closely approach the vertical center line through the mouth 12, with each wire alternately being supported by a deflector while the opposing length of wire, which extends between a pair of deflectors at respectively higher and lower levels, can to some extent move back and forth in response to its tension and the pressure of the liquid between the wires at that level in the wedge zone.

As already noted, the deflectors 25 should be mounted in accordance with predetermined forming conditions to provide for drainage at a calculated rate from the wedge zone 13, as will be understood from a specific example. The essential conditions considered in these calculations comprise machine (wire) speed and width, basis weight of the sheet to be produced, the width of the slice outlet from the headbox, the initial solids consistency of the stock, and the solids consistency desired at the downstream end of the wedge zone.

The purpose of the wedge zone, as defined by the deflectors 25, is to effect gentle drainage of substantially all of the initial free draining water from the sheet before the wires and sheet enter the pressure zone at the upstream end of the shoe structure 20. This value will vary for different stocks and types of paper, and for the purposes of this example, it is assumed to be 4%, as compared with an initial fiber consistency of 0.8% for the stock entering the wedge zone from the headbox 22. The other values assumed for this example are a basis weight for the sheet of 30 lbs. per 3,000 square foot ream, a machine speed of 3,000 feet per minute, and a machine width of 1 ft.

The initial controlling value for this example is the solids consistency of the sheet when the initial free draining water has been eliminated. At the assumed 4% consistency, the stock necessary to make a ream of 30 lb. basis weight paper will comprise 30 lbs. of fiber and 720 lbs. of water, which gives a total of 750 lbs. or approximately 12 cubic feet or 90 gallons, and at the assumed wire speed of 3,000 feet per minute, the result is a thickness of 0.048 inch. This value of 0.048 inch will be the thickness of the stock between the two wires at the small end of the wedge zone.

The minimum value for the initial volume of stock required at 0.8% consistency to produce a ream of 30 lb. paper will be 3,750 lbs., i.e. a flow rate of 3,750 lbs. per minute, made up of 30 lbs. of fiber and 3,720 lbs. of water. This converts to approximately 60 cubic feet or 448 gallons, and at 3,000 feet per minute will be an initial jet 0.24 inch thick. This calculation, however, does not take into consideration the retention factor, i.e. what quantity of fines will be lost with the free water draining through the wires. A fair initial retention factor for this example is 80%, and when this is worked into the calculations, the initial volume will increase to 4,688 lbs., made up of 37.5 lbs. of fiber and 4,650 lbs. of water, which in turn converts to a jet width of 0.300 inch at a flow rate of approximately 560 gallons per minute.

On the basis of these calculations, it is apparent that a total of 472 gallons per minute of liquid (water and fines) should drain from the wedge zone as the wires travel from the first deflector 25, which is preferably located near, but slightly below, the level where the stock jet impinges on the wires, to the upper end of the shoe structure 20, a vertical distance which may be as short as in the range of 18–24 inches. Thus the total convergence of the wire will be only about 0.250 inches from one end of the wedge zone to the other, and if this is over a travel of 24 inches, drainage through each wire will be at an average rate of 118 gallons per minute per foot of face but will actually be at a higher initial rate and will be progressively retarded as a mat of fiber forms on the face of each wire within the wedge zone.

For optimum results, it is therefore desirable to calculate the thickness of the wedge zone at levels where selected intermediate consistencies are obtained, e.g. 2%, and set the deflectors 25 accordingly. Calculated on the same basis as above, and taking the retention factor into consideration, this thickness value will be approximately 0.100 inch, the flow rate past that level will be approximately 187 gallons per minute, and 455 gallons per minute of white water (including fines) will drain through the two wires between that level and the uppermost deflector 25.

Similarly at 3% consistency, the thickness value will be approximately 0.064 inch, and the flow rate past that level will be approximately 120 gallons per minute. Approximately 67 gallons per minute of white water will therefore drain through the wires between the 2% and 3% consistency levels, leaving approximately 30 gallons per minute to be drained during travel of the wires and sheet from the 3% level to the shoe structure 20 at which the consistency is established to be 4%.

It is most important for optimum sheet formation that the drainage be gentle and natural, rather than forced, and that the wires be supported as nearly as practicable in properly converging relation in accordance with the desired gentle drainage rate. The values can be approximated, however, and it will be seen from the calculations outlined above that approximately 80% of the drainage occurs above the 2% consistency level, and that two-thirds of the further drainage occurs between the 2% and 3% levels. However, since drainage is at a continuously decreasing rate, due to retardation of the fiber mat forming in the wedge zone on the surface of each wire, these figures can be approximated on the basis that the 2% consistency level should be about two-thirds of the way down the wedge zone.

Carrying these calculations further, if the vertical extent of the wedge zone is 24 inches, it can be assumed that the 2% consistency level will be approximately 12 inches above the upper end of the shoe structure 20, and that the 3% consistency level will be approximately 6 inches lower. On this basis, one of the deflectors 25 may be selected for mounting at the 2% consistency level, and its lateral position should be adjusted so that its working portion which engages the adjacent wire will be located at a distance from the plane connecting the nearest pair of opposed deflectors which is equal to 0.100 inch plus the thickness of the two wire reaches.

Similarly another deflector may be mounted at the 3% consistency level and correspondingly adjusted laterally with respect to the plane connecting the nearest opposed pair of deflectors, or connecting the top of the shoe structure 20 and the lowest deflector on the opposite side of the wedge zone. The lateral positioning of the 3% deflector should of course be adjusted to provide a spacing between the wires of 0.064 inch plus the thickness of the two wires.

With two deflectors 25 positioned and adjusted as just described, the remaining deflectors can be correspondingly adjusted, along with the tension of the wires, to maintain each of the wires as straight as possible in its travel between each pair of supporting deflectors. Some catenary formation may take place between adjacent deflectors without undesirable effecting forming conditions, but if the principles of the invention as explained above are properly applied, each wire may change direction in traveling over the edge of one or more of its supporting deflectors, but both wires will not change direction in traveling past the same deflector.

These conditions can be effected and maintained, for example, if the deflectors which engage one wire, e.g. the backing wire 15, have fixed mountings on the frame of the machine, possibly with provision for pivoted adjustment about the axis defined by their leading edges. In such case, the deflectors for the other wire should be mounted for vertical and lateral adjustment as required to effect the desired deflector relationships as explained above. Enough adjustment should be provided for to control the extent of catenary formation between any pair of deflectors and to maintain it as small as practicable.

As already explained, the purpose of the deflectors 25 is to effect as nearly as possible complete removal of the easily drained water from the forming sheet in the wedge zone so that when the wires and sheet reach the upstream end of the shoe structure 20, they will be in essential parallelism, the water still remaining with the sheet will be that retained in the sheet structure and requiring additional physical pressure application for removal therefrom. The shoe structure 20 accordingly defines the pressure zone, which may be positive pressure or a combination of positive and negative pressures, as now described.

The shoe structure 20 preferably is provided with a convexly curved intermittent surface of relatively long radius, which is shown as defined by multiple spaced rib members 30 having their edges contoured to produce the desired curved intermittent surface. The shoe structure 20 is preferably fixedly mounted in the frame in such relation with the lowermost deflector 25 and the turning roll 21 that engagement between its uppermost end and the carrying wire 16 will force both wires away from a direct path to the turning roll 21 so that with proper tension in the backing wire 15, it will apply pressure to the sheet against the carrying wire 16 and the surface of shoe structure 20, thereby forcing water through both wires and to a suitable saveall 33 positioned above turning roll 21 or into the interior of the shoe structure 21.

With the intermittent surface of the shoe structure defined by the edges of multiple spaced rib members as described in the preceding paragraph, and with both of the wires under proper tension, they will follow a segmented path of travel from each rib edge to the next. The action in the pressure zone on the wet sheet between the wires will therefore differ markedly from the action within the wedge zone 13. Instead of the controlled gentle drainage from the wedge zone, with only one of the wires changing direction around each deflector, both of the wires and the sheet will change direction as they pass around each successive rib edge. The tensioned backing wire 15 will therefore continuously apply pressure on the sheet against the carrying wire 16, and this pressure will be accentuated as the wires and sheet change their direction around each successive rib edge.

The positive pressure exerted by the wire 15 through its tension may be supplemented by vacuum applied to the interior of the shoe structure 30. For example, the lower or downstream portion thereof may be separated from the upper portion by a partition and connected to an appropriate source of vacuum in conventional manner.

After the wires and sheet wrap roll 21, they travel generally horizontally to a suction couch roll 35 having at least one suction box 36 in the upper quadrant on the side thereof away from roll 21. A guide roll 37 is positioned to peel the upper wire 15 away from the lower wire and the sheet along a line over the suction box 36, and an additional guide roll 38 supports the wire 15 as it returns to the breast roll 10.

A shoe structure 40, which may be of the same construction as the shoe structure 20, is positioned with its convexly curved intermittent surface defined by multiple ribs 41 in engagement with the exposed under surface of the stretch of wire 16 traveling from roll 21 to roll 35. The position of shoe structure 40 is similar to that of shoe 20 in that it will force both of the wires and the sheet therebetween out of the line of direct travel from roll 20 to roll 35 into a curved path and thereby maintain pressure on the sheet through the tension in both wires to cause continued dewatering of the sheet through the lower wire 16 into the shoe structure 40, which may if desired have its interior connected to a source of vacuum, as indicated at 42.

A turning roll 44 leads the wire 16 and sheet downwardly at an angle from the couch roll 35 in substantially the same pattern as a conventional turning roll and couch roll arrangement in a Fourdrinier paper machine so that the sheet can be picked up by a conventional suction pick-up roll 45 and felt 46. The return run of the wire 16 to breast roll 11 is supported by a plurality of guide rolls 48.

The invention as illustrated in FIG. 1 provides a number of significant advantages. One is to effect formation as rapidly as possible, by use of the small number of relatively closely spaced deflectors 25, so that the two wires are running in essential parallelism with the formed sheet therebetween when they reach the upper edge of the shoe structure 20. This member serves to maintain both wires under tension and thereby in pressure engagement with the sheet therebetween as they continue their travel to the turning roll 21, thereby effecting further dewatering, and this dewatering action continues as the wires wrap the turning roll and are again subjected to tensioning and pressure engagement with the sheet as they travel around the shoe structure 40 to the couch roll 35.

Note also that the tension in the wires will cause extrusion of liquid through the wire 16 in wrapping the turning roll 21 if it is an imperforate roll, and additional liquid removal can be effected by using a blow roll as the turning roll 21, i.e. a perforate roll with an internal air pressure box in the lower right quadrant of roll 21 in FIG. 1. In either case, roll 21 should be provided with a saveall pan 50.

The arrangement of the guide roll 37 to lift the upper wire 15 as the lower wire and sheet are crossing the suction box 36 promotes clean separation of the upper wire while the sheet is held down on the lower wire between suction box. The subsequent travel of the lower wire promotes pick-up of the sheet by a reliable conventional pick-up arrangement.

Figure 2:
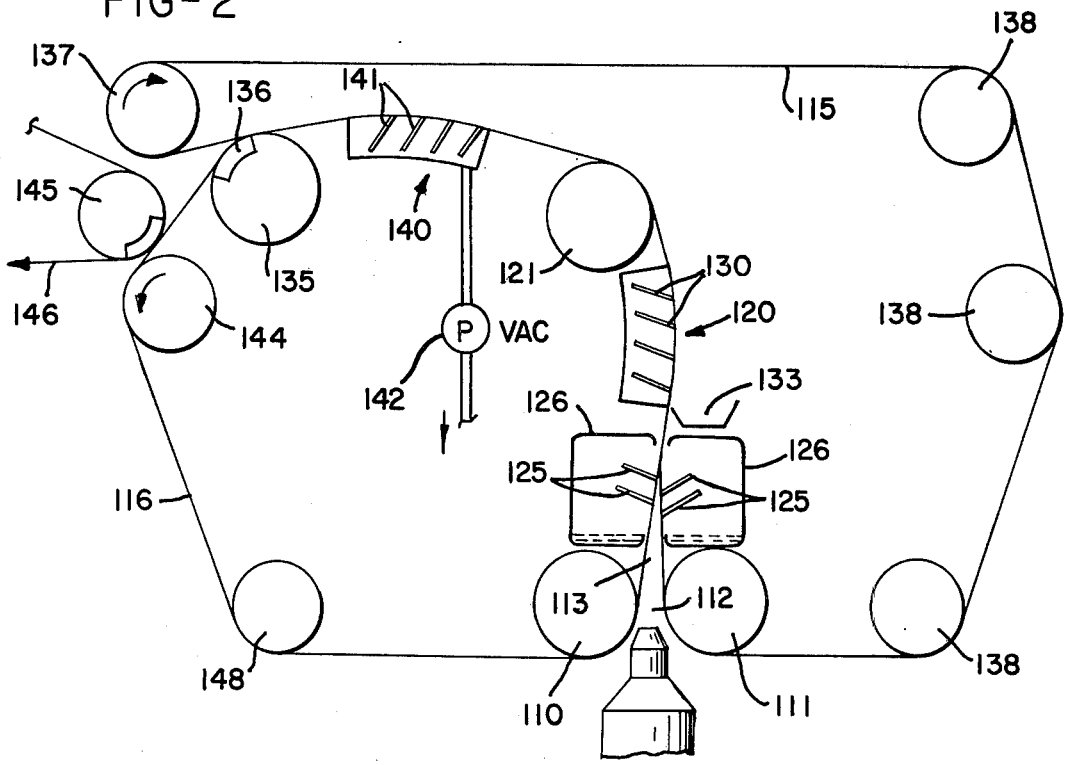
FIG. 2 is a similar view of a paper machine and sheet pick-up arrangement wherein the wires travel upwardly along the forming zone.

The forming section shown in FIG. 2 represents in effect an upside-down version of FIG. 1 which is otherwise intended to operate in accordance with the principles of relative wire and stock jet speeds disclosed in U.S. Pat. No. 3,597,315. Accordingly, the same reference characters are used in a 100 series, i.e. breast rolls 110–111, forming zone mouth 112, wedge zone 113, wires 115 and 116, shoe structure 120 and turning roll 121. The deflectors 125 are preferably provided with savealls 126 generally as shown in U.S. Pat. No. 3,597,315, and note also that turning roll 121 may advantageously be provided with one or more suction boxes in its upper right hand quadrant for further dewatering of the sheet through the carrying wire 116. As FIG. 2 shows, the result is to provide essentially the same operating characteristics and advantages discussed in connection with FIG. 1, and the arrangement provided by the suction couch roll 135, guide roll 137 and turning roll 144 is essentially the same as in FIG. 1.

Figure 3:
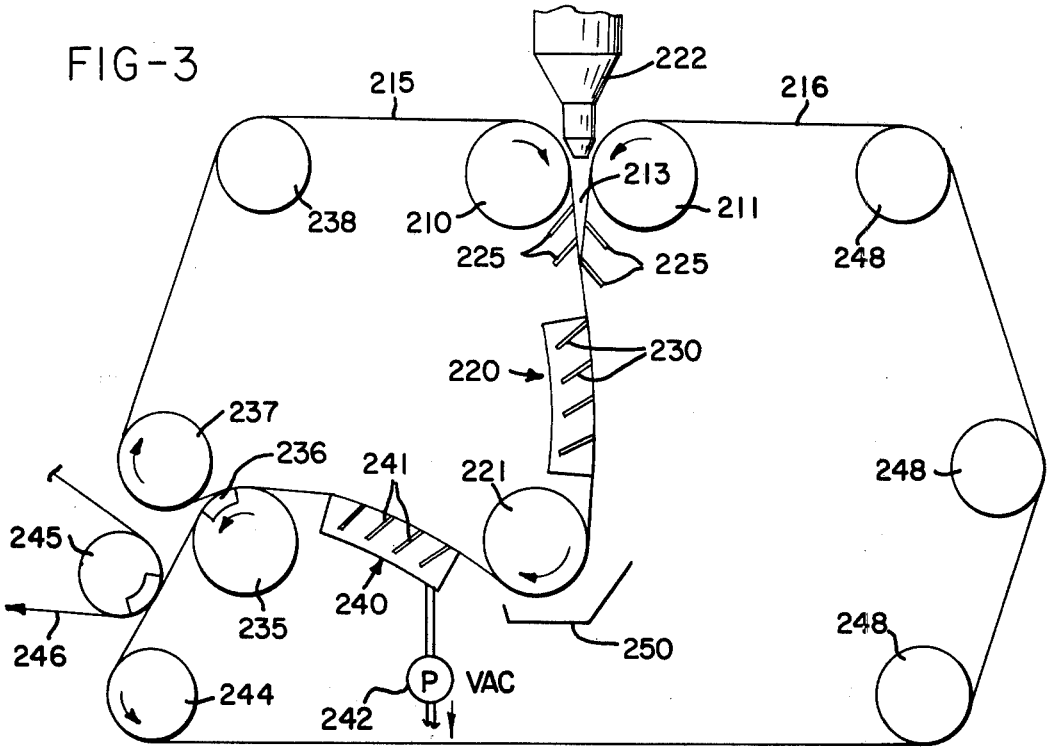
FIGS. 3 and 4 are similar views showing modifications of the arrangements of FIGS. 1 and 2 respectively.

The forming section shown in FIG. 3 corresponds closely to that of FIG. 1 and uses the same reference characters in a 200 series, i.e. breast rolls 210–211, etc. The difference between the two arrangements is that in FIG. 3, the shoe structure 220 is positioned on the opposite side of the two wires so that it engages the backing wire 215 between the lowermost deflector 225 and the turning roll 221. After the wires and sheet lead the turning roll, however, they are in the same relation as in the arrangement of FIG. 1 as they travel across the shoe structure 240 to the couch roll 235. This arrangement therefore offers the same advantages as that of FIG. 1.

Figure 4:
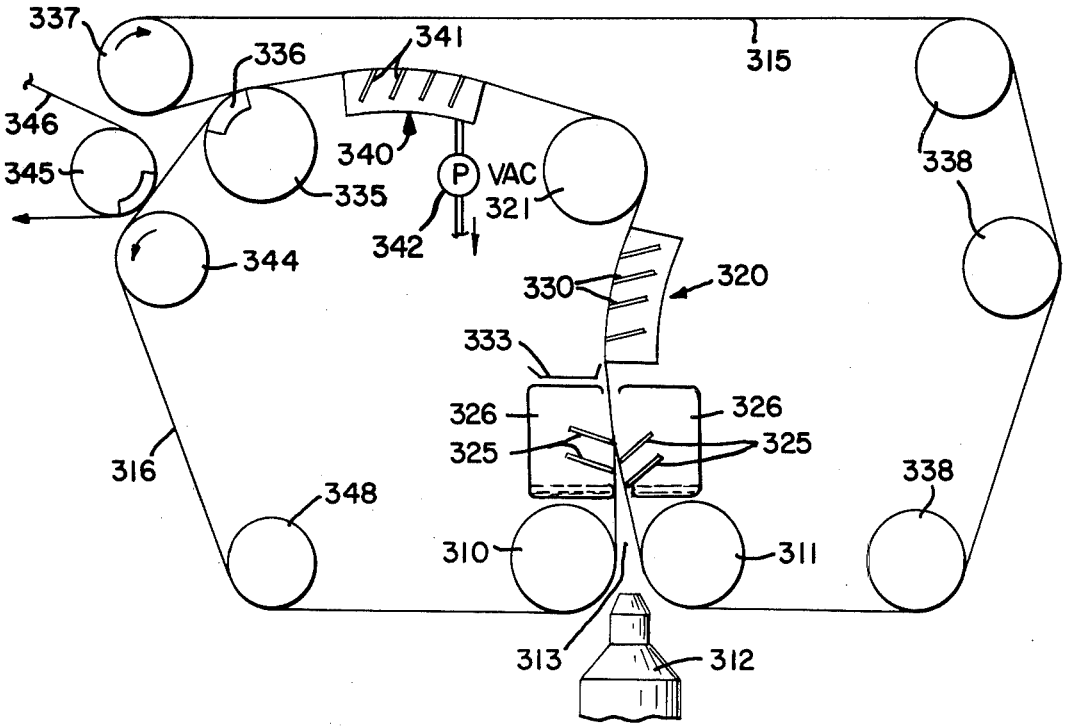

The forming section shown in FIG. 4 bears the same relation to that of FIG. 2 as the relationship of FIGS. 3 and 1, and therefore uses the same reference characters in a 300 series. Thus the shoe structure 320 is positioned for direct engagement by the backing wire 315, but this condition is reversed as the wires and sheet travel across the second shoe structure 340 to the couch roll 335. The arrangement of FIG. 4 accordingly offers the same operating characteristics and advantages as that of FIG. 2.

Figure 5:
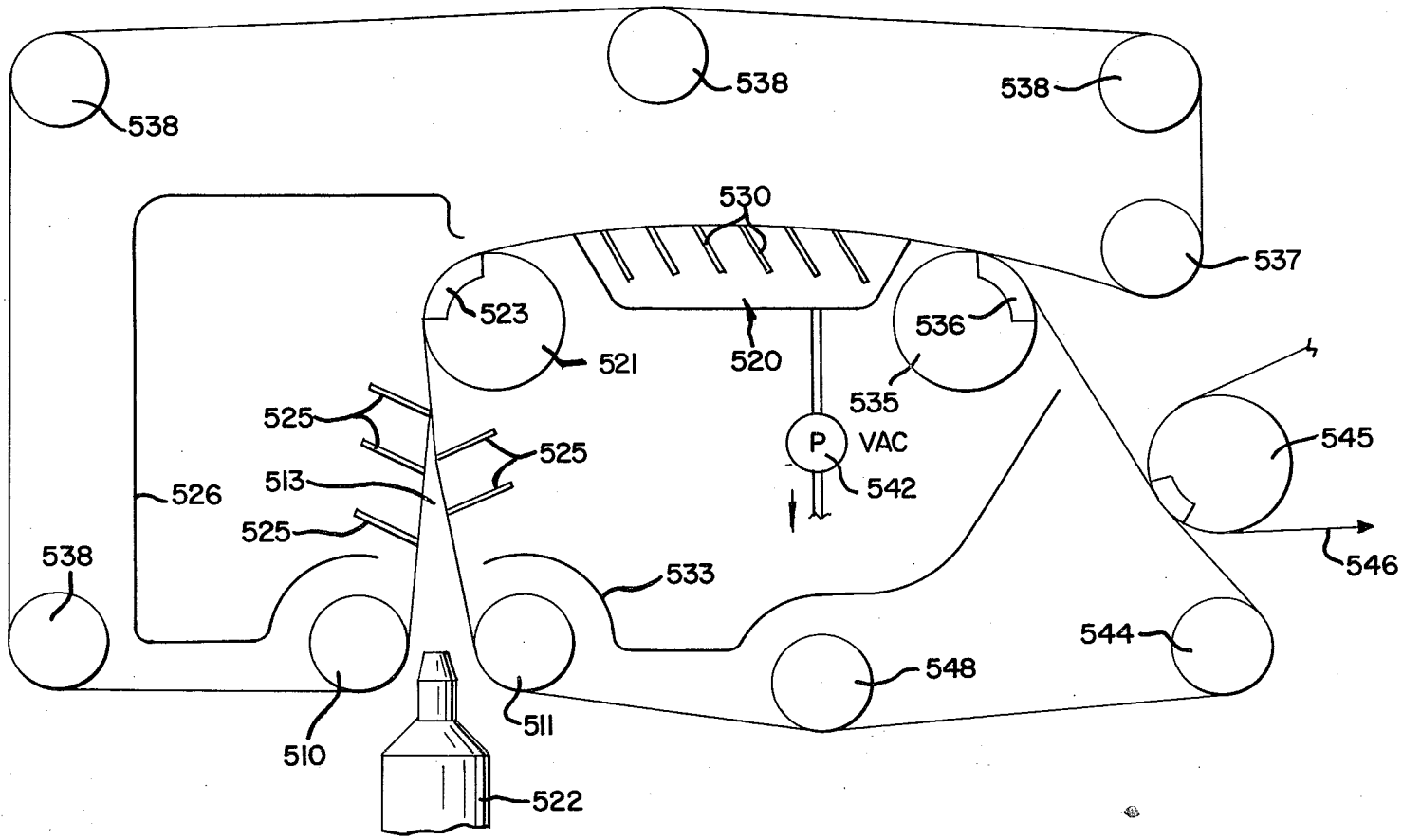
FIG. 5 is a similar view showing another arrangement in accordance with the invention wherein the wires travel upwardly along the forming zone.

FIG. 5 shows a forming section similar to those of FIGS. 2 and 4 in that the wires travel upwardly in defining the wedge zone, but otherwise of modified construction to reduce the overall height of the machine. The parts which correspond directly to parts in the other drawings use similar reference characters in a 500 series, but it will be noted that the turning roll 521 is positioned immediately above the uppermost deflector 525 and cooperates therewith to define the beginning of the pressure zone. Additionally, roll 521 has one or more suction boxes 523 in its upper left-hand quadrant to apply vacuum to the wires and sheet supplementing the pressure on the sheet of the tension in the backing wire 515.

A shoe structure 520 is positioned below the run of the wires from the turning roll 521 to the suction couch roll 535, and the positions of this shoe structure with respect to the rolls 521 and 535 and the turning roll 544 and wire guide roll 537 assure maintained tension in the wires as they carry the sheet across the top of the shoe structure 520. Preferably the interior of the shoe structure 520 will be connected to a source of vacuum as indicated at 542.

The arrangement of the deflectors 525 in FIG. 5 should be in accordance with the principles of the invention discussed in connection with FIG. 1, and the arrangement of FIG. 5 will therefore provide the same operating advantages in addition to simplicity and reduced space requirements. It will of course be understood that FIG. 5 is diagrammatic, and that the distance between the rolls 521 and 535 and the length of shoe structure 540 may be increased as may be found desirable to establish proper operating conditions and sheet formation.

While the apparatus herein described constitute preferred embodiments of this invention, it is to be understood that the invention is not limited to these precise forms of apparatus, and that changes may be made in either without departing from the scope of the invention.

What is claimed is:

1. Apparatus for forming a paper sheet between a pair of forming wires and including a pair of breast rolls cooperating to support a pair of generally vertically traveling reaches of said wires in opposed generally horizontally spaced relation defining a mouth of predetermined width, and headbox means for supplying paper making stock to said mouth at a first predetermined solids consistency as a sheet-like jet of a thickness less than the width of said mouth, comprising (a) guide means cooperating with said wire reaches to establish a wedge zone wherein said reaches converge generally vertically downstream from said mouth to a relative spacing determined by the thickness of the stock therebetween at a second predetermined solids consistency resulting from drainage of liquid through said reaches at a calculated rate, (b) said guide means being deflector members positioned to engage and support said reaches in said converging relation as liquid extrudes through said reaches while the fibers remaining between said reaches form a paper sheet, (c) said deflector members being arranged in vertically alternating relation on opposite sides of said wedge zone and in progressively more closely spaced relation with the vertical center line of said wedge zone such that the distance from each deflector member to a plane connecting the closest opposed pair of said deflector members substantially corresponds to the thickness of said reaches plus the thickness of the stock between said reaches at the vertical level of said deflector member at said calculated drainage rate, (d) support means cooperating with said wire reaches to define a pressure zone located downstream from the smaller end of said wedge zone and including means defining a convexly curved intermittent surface, (e) means for guiding said wires from the most downstream of said deflector members into wrapping engagement with said intermittent surface while maintaining both of said wires under tension causing pressure on said sheet and continued extrusion of liquid through said wires in traveling across said surface, (f) means for directing said wires with said sheet therebetween away from the downstream end of said pressure zone, (g) means downstream from said pressure zone for effecting separation of one of said wires from said sheet and the other said wire, and (h) transfer means for removing said sheet from said other wire for delivery to a further processing station.

2. Apparatus as defined in claim 1 wherein said surface defining means includes a plurality of spaced rib members having edges thereof arranged in a curved path and thereby causing said wires to follow a segmented path of travel from each of said edges to the next.

3. Apparatus as defined in claim 1 further comprising means for applying vacuum to said wires and sheet through said intermittent surface.

4. Apparatus as defined in claim 2 wherein said guiding means includes a turning roll positioned downstream from said most downstream deflector member, and wherein said intermittent surface is positioned between said most downstream deflector member and said turning roll.

5. Apparatus as defined in claim 4 further comprising means defining a second convexly curved intermittent surface positioned downstream from said turning roll and facing generally upwardly, and means for guiding said wires from said turning roll over and into wrapping engagement with said second intermittent surface while maintaining both of said wires under tension causing pressure on said sheet and continued extrusion of liquid through the lower of said wires in traveling across said second intermittent surface.

6. Apparatus as defined in claim 5 further comprising means for applying vacuum to said wires and sheet through at least one of said intermittent surfaces.

7. Apparatus as defined in claim 4 wherein said turning roll is located below said breast rolls to establish downward travel of said wire reaches from said mouth to said turning roll.

8. Apparatus as defined in claim 4 wherein said turning roll is located above said breast rolls to establish upward travel of said wire reaches from said mouth to said turning roll.

9. Apparatus as defined in claim 2 wherein said guiding means includes two turning rolls, the first of which rolls is located above said breast rolls to establish upward travel of said wire reaches thereto from said mouth and the second of which rolls is positioned in laterally spaced relation from said first turning roll, wherein said intermittent surface is positioned between said turning rolls and faces generally upwardly, and wherein said guiding means guide said wires from said first turning roll to said second turning roll over said surface under tension causing extrusion of liquid through the lower of said wires and said intermittent surface.

10. Apparatus for forming a paper sheet between a pair of forming wires and including a pair of breast rolls cooperating to support a pair of generally vertically traveling reaches of said wires in opposed generally horizontally spaced relation defining a mouth of predetermined width, and headbox means for supplying paper making stock to said mouth at a first predetermined solids consistency, comprising (a) guide means cooperating with said wire reaches to establish a wedge zone wherein said reaches converge generally vertically from said mouth to a relative spacing determined by the thickness of the stock therebetween at a second predetermined solids consistency resulting from drainage of liquid through said reaches at a calculated rate, (b) said guide means being deflector members positioned to engage and support said reaches in said converging relation as liquid extrudes through said reaches while the fibers remaining between said reaches form a paper sheet, (c) said deflector members being arranged in vertically alternating relation on opposite sides of said wedge zone and in progressively more closely spaced relation such that the distance from each deflector member to a plane connecting the closest opposed pair of said deflector members substantially corresponds to the thickness of said reaches plus the thickness of the stock between said reaches at the vertical level of said deflector member at said calculated drainage rate, (d) a first turning roll located above said breast rolls to establish upward travel of said wire reaches from said mouth to said turning roll, (e) a second turning roll positioned in laterally spaced relation with said first turning roll, (f) means defining a convexly curved intermittent surface positioned between said turning rolls and facing generally upwardly, (g) means for guiding said wires into wrapping relation with both of said turning rolls and said intermittent surface while maintaining both of said wires under tension causing pressure on said sheet and continued extrusion of liquid through the lower of said wires and said intermittent surface, (h) means for effecting separation of the upper of said wires from said sheet and said lower wire at a position downstream from the point of engagement of said lower wire with said second turning roll, and (i) transfer means downstream from said second turning roll for removing said sheet from said lower wire for delivery to a further processing station.

11. Apparatus as defined in claim 10 wherein said first turning roll includes a suction box within the portion thereof wrapped by said wires, wherein said second turning roll includes a suction box in the portion thereof wrapped by said lower wire, and wherein said guiding means includes a guide roll positioned to direct said upper wire away from said sheet and said lower wire along a line overlying said suction box in said second turning roll.

* * * * *